United States Patent [19]

Johnson

[11] Patent Number: 4,951,423

[45] Date of Patent: Aug. 28, 1990

[54] TWO SIDED ABRASIVE DISC WITH INTERMEDIATE MEMBER

[75] Inventor: Courtland M. Johnson, P.O. Box 690 Prospect Hill Rd., Hancock, N.H. 03449

[73] Assignees: Cynthia L. B. Johnson; Courtland M. Johnson, Hancock, N.H.

[21] Appl. No.: 440,465

[22] Filed: Nov. 20, 1989

Related U.S. Application Data

[63] Continuation of Ser. No. 242,787, Sep. 9, 1988, abandoned.

[51] Int. Cl.[5] ..... B24B 41/00

[52] U.S. Cl. ..... 51/168; 51/206 NF; 51/209 R; 51/358

[58] Field of Search ..... 51/358, 206 R, 206 NF, 51/207, 209 R, 168, 401

[56] References Cited

U.S. PATENT DOCUMENTS 2,175,073 10/1939 Amstuz ..... 51/401
2,316,161 4/1943 Harvey ..... 51/209 R
2,690,632 10/1954 Sevic ..... 51/207
3,250,045 5/1966 Caserta ..... 51/209 R
3,844,072 10/1974 Haigh et al. ..... 51/401

*Primary Examiner*—Frederick R. Schmidt
*Assistant Examiner*—M. Rachoba
*Attorney, Agent, or Firm*—Davis, Bujold & Streck

[57] ABSTRACT

A finishing article comprising a backing member defining a central opening and having two opposed surfaces each carrying an abrasive material thereon; an intermediate member, having a central bore therethrough, being positioned in the opening and attached to the backing member, the central bore is capable of being at least partially threaded for supporting the finishing article to a support member. The partially threaded bore of the finishing article is detachably connectable to a threaded portion of a support member to provide rotational movement from the support member to the finishing article for finishing an object wherein the partially threaded portion of the central bore lies substantially in the plane of the backing member so that both abrasive surfaces of the finishing article can be used for abrasive sanding and, if desired, the abrasive surfaces of the article can carry different grades of abrasives.

19 Claims, 2 Drawing Sheets

TWO SIDED ABRASIVE DISC WITH INTERMEDIATE MEMBER

This is a continuation of application Ser. No. 242,787, filed on Sept. 9, 1988, now abandoned.

The field of art to which the present invention pertains is the field of surface finishing and more particularly with respect to a two-sided finishing article which is capable of being detachably supported by a drive member, such as a shank or the like.

BACKGROUND OF THE INVENTION

A variety of prior art finishing devices have been developed for the finish of objects, for instance those disclosed in U.S. Pat. Nos. 3,667,169, 3,667,170, 4,258,509, 3,491,494, 3,747,286 and 3,866,361. Each of the above mentioned prior art references teach a variation of a finishing device which has only one surface capable of finishing an article while the opposite surface of the device is used primarily for accommodating some form of support member, such as a male coupling, a hub, a backing pad, etc., extending from that surface to provide means for connecting the finishing device to a drive member. One of the drawbacks associated with prior art finishing devices is that a surface which is capable of supporting an abrasive material for finishing is totally ignored in favor of a supporting member for supporting the finishing member to the drive member.

SUMMARY OF THE INVENTION

Accordingly, a primary object of the present invention is to provide a finishing article which is relatively simple and inexpensive to manufacture and which provides two abrasive surfaces for finishing of objects.

A further object is to provide a surface finishing article which is easily connectable and disconnectable to a drive member.

A more specific objective is to provide a finishing article for rotatable engagement with a support member having engaging means on one end thereof, said finishing article including backing means defining a central opening and having two opposed substantially planar surfaces, each carrying an abrasive material thereon; and an intermediate member, defining a central bore, being positioned in said central opening and being attached to said backing means, said central bore and said central opening being coaxle with one another, a portion of said central bore being engagable with engaging means on one end of a support member for transmitting rotational movement from said support member to said finishing article wherein said engagable portion of said central bore lies substantially between said two planar surfaces whereby said finishing article can be detachably connected to said support member by said intermediate member so that both abrasive surfaces can be used for finishing an article; said support member comprises a spindle having engaging means at one end thereof the other end being engagable with a drive member; a reinforcing member, defining a central bore, being supported by the engaging means of said spindle; and a locking member engaging said engaging means adjacent said reinforcing member for adjusting a length of the engaging means extending out through the central bore of the reinforcing member available for engagement with said intermediate member.

DESCRIPTION OF THE DRAWINGS

The invention may be better understood by reference to the annexed drawings which illustrate preferred embodiments of the invention, given by way of example, it being understood that other embodiments employing the same principles may be made as will become readily apparent to those skilled in the art, wherein.

DESCRIPTION OF THE PREFERRED EMBODIMENT

Figure 1:
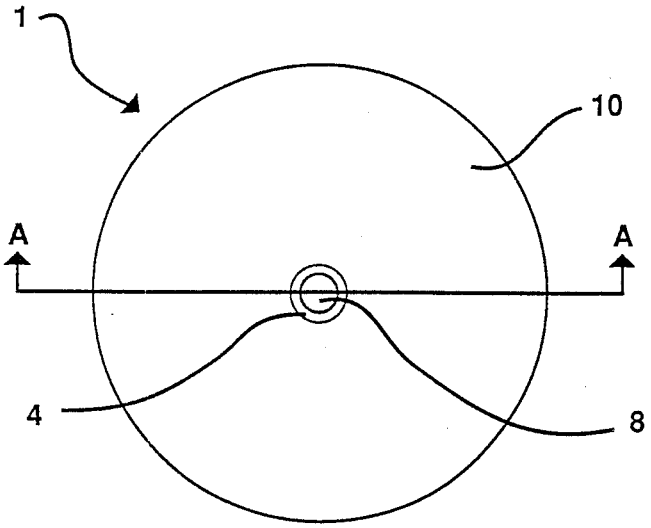
FIG. 1 is a front elevational view of a finishing article in accordance with a first embodiment of the present invention.
Figure 2:
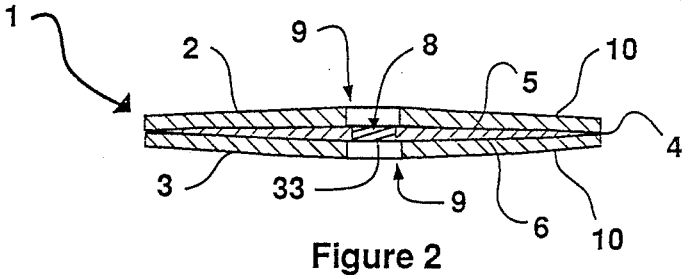
FIG. 2 is a cross-sectional view of the finishing article of FIG. 1 along line A—A.

Turning first to FIGS. 1 and 2, the preferred embodiment of the finishing article 1 of the present invention is shown to comprise an intermediate member 4, such as a disc, a washer or other similar flat planar member, having two opposed substantially parallel disc carrying surfaces 5, 6 with a central bore 8 therethrough. A first disc member 2 having an abrasive material 10 of a desired grit size carried on one side thereof and a second, opposite, side of the disc which is attached to the disc carrying surface 5 by any conventional adhesive well known in this art. A second disc member 3 having an abrasive material 10 of a desired grit size carried on one side thereof is attached by its second, opposite, side adhesively to the other disc carrying surface 6 of the intermediate member 4, to form a finishing article having two abrasive surfaces available for sanding an object.

Both disc members 2, 3 have a central opening 9, preferably of a diameter between 5/16 and $\frac{7}{8}$ inches, in the center thereof. This opening is large enough to allow threaded portion 16 (see FIGS. 5 and 6), on one end of a spindle 15, to pass therethrough with ample clearance. The disc members 2, 3 preferably have diameters between 0.75 and 9 inches.

The intermediate member 4 is preferably made of a high strength synthetic or plastic such as polyvinyl sheeting, vulcanized fibre, nylon, polyester or polypropylene, a metal such as aluminum, steel, brass, copper, etc., or other similar materials which are capable of securely attaching the article by at least a partial threaded engagement with a threaded drive member. It is important that the material chosen for the intermediate member be of sufficient strength to support adequately the finishing article 1 when subjected to grinding and sanding forces. The over-all dimensions (diameter, thickness, type of material, degree of taper, etc.) of the intermediate member 4 are chosen to provide the desired degree of stiffness for a given grinding situation.

Figure 3:
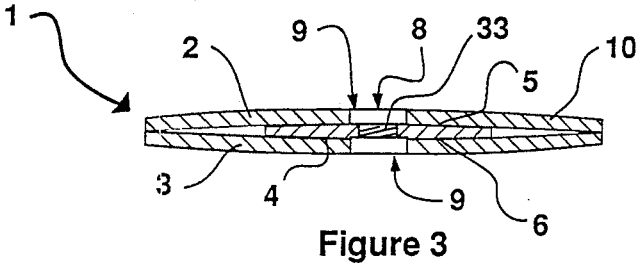
FIG. 3 is a cross-sectonal view, similar to the view shown in FIG. 2, of a second embodiment of the invention.
Figure 4:
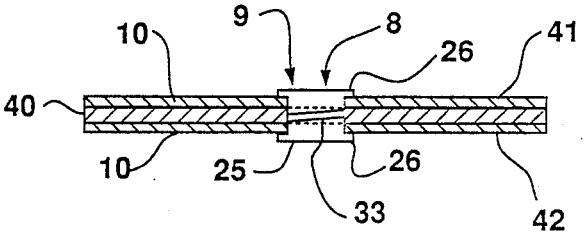
FIG. 4 is a cross-sectonal view, similar to the view shown in FIG. 2, of a third embodiment of the invention.

The partially threaded portion 33 of the central bore engages a mating threaded portion (the engaging means) 16 of the support member 14 to support the finishing article 1 during a sanding operation. The partially threaded portion 33 and the thread portion 16 mate with one another and are preferably threads having a size between ¼ inch diameter 20 threads per inch and ⅜ inch diameter 11 threads per inch. The intermediate member 4 must provide sufficient disc carrying surface area to allow secure adhesive attachment thereto of the opposite surfaces of the first and second disc members 2, 3. The disc carrying surfaces 5, 6 of the intermediate member 4 are substantially parallel to one another and preferably taper slightly toward one another near the outer periphery of the intermediate member, as can be seen in FIGS. 2 and 3. In FIG. 3, the opposite sides of the disc 2, 3 are attached to each other near the outer periphery. In FIG. 4, the finishing member 1 comprises a backing member or means 40, defining a central opening 9, having two opposed substantially planar surfaces 41, 42 each carrying an abrasive material 10 thereon. Alternatively, two disc members 2, 3 aligned with their rear surfaces adhesively attached to one another by a conventional adhesive, similar to those shown in FIGS. 1–3, could be used. An intermediate member 25, such as a rivet, a grommet or the like, is positioned in the central opening 9 of the backing member 40. The member 25 has an central bore 8 capable of being at least partially threaded for supporting the finishing article 1 to the support member 14. The member 25 has two exterior flange portions 26, positioned on opposite ends of the bore 8, which compressibly clamp the outer edges of the central opening 9 of the backing member 40, or the disc members 2, 3, and thereby firmly connect the member 25 to the member 40 or 2, 3 so that the member 25 is capable of transmitting rotational movement from the drive member to the member 40 or 2, 3.

Figure 5:
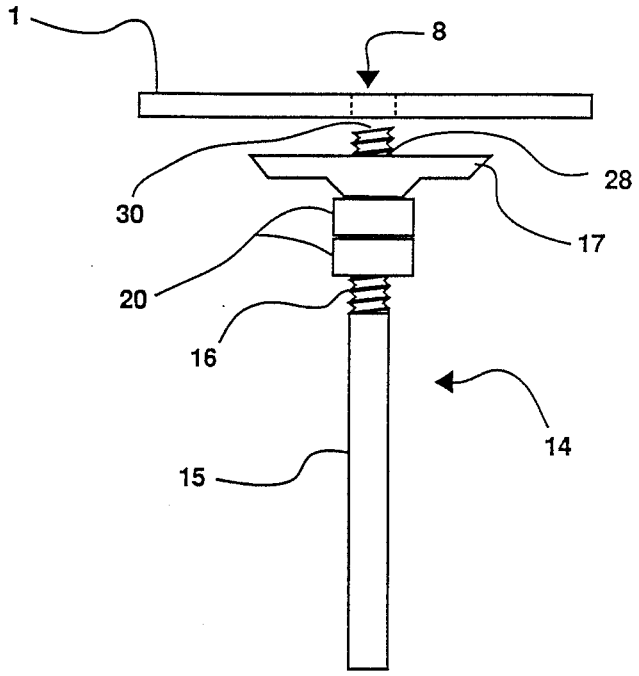
FIG. 5 is a front-elevational view of a support member used to carry the finishing article of the present invention.

Turning now to FIG. 5, support member 14 comprises a spindle or mandrel 15 having a threaded portion 16 at one end thereof The opposite end of the spindle 15 is adapted co be engagable with a suitable drive member (not shown), such as a drill. The support member 14 further includes a reinforcing member 17, commonly used in this art, having a central bore 28 therethrough. The reinforcing member 17 is made from rubber or other similar materials which adequately support a rear surface of the finishing article 1 when used in a grinding operation. A locking member 20, such as two nuts, is provided on the threaded end 16 of spindle 15, behind the reinforcing member 17, and the locking member 20 engages with the rear surface of the reinforcing member 17 to lockably adjust the length of threaded portion 16 extending out through the central bore 28 of the reinforcing member 17. This length is adjusted so that when the finishing article 1 is threaded onto the support member 14, the end surface 30 of the threaded portion 16 will be flush with, or slightly recessed inside, the outer abrasive surface of the attached finishing member so as not to interfere with the grinding operation.

Figure 6:
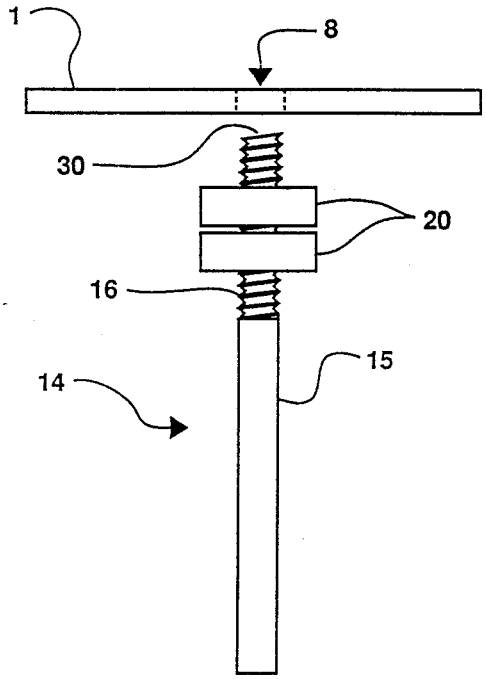
FIG. 6 is a front-elevational view of a second embodiment of a support member used to carry the finishing article of the present invention.

An alternate arrangement of the support member is shown in FIG. 6 in which the reinforcing member 17 is omitted. This embodiment is only feasible if the finishing article is sufficiently stiff to adequately support itself, via the intermediate member, during a finishing operation or if a flexible finishing article 1 is desired. If the intermediate member 4 is not rigid enough, or if extra rigidity of the finishing article 1 is required for a particular sanding situation, then the arrangement shown in FIG. 5 is utilized.

A further advantage of the present invention is that the first and second disc members 2, 3 can contain different grades of abrasive materials on their respective sides, such as course/medium, medium/fine, fine/extra fine, etc, so that a single finishing article can vary the degree of finishing achieved in a particular situation by simply flipping the finishing article over and using the opposite side.

The term "partially threaded" engagement, as used in this application, is intended to include other known arrangements apparent to those skilled in the art for engaging a drive member to a driven member such as projections, engaging slots, annular vanes, etc. In addition, the engagable portion (for instance the threads) of the central bore can be formed therein either by engagement with the engaging means of the support member or it can be formed prior to the initial engagement, such as during manufacturing of the finishing article.

Thus, the finishing article as provided herein is economical to manufacture, durable and provides two separate and opposed surfaces for abrasive sanding. Although only a few specific embodiments of the finishing article contemplated by the present invention have been described and illustrated above, it is emphasized that various changes may be made in the above finishing article without departing from the spirit and scope of the present invention.

I claim:

1. A disposable, flexible, nonvitrified double-sided sanding disc, for rotatable engagement with a support member having engaging means on one end thereof, said double-sided sanding disc comprising:

flexible circular backing means defining a central opening and having two opposed substantial circular planar surfaces with abrasive material permanently affixed directly to and only on both said circular planar surfaces prior to use; and an intermediate member, defining a central bore, being positioned in said central opening and being attached to said backing means, said central bore and said central opening being coaxial with one another, a portion of said central bore being engagable with engaging means on one end of a support member for transmitting rotational movement from said support member to said sanding disc wherein said engagable portion of said central bore lies substantially between said two planar surfaces whereby said sanding disc can be detachably connected to said support member by said intermediate member so that both abrasive surfaces can be used for finishing an article.

2. A sanding disc in accordance with claim 1, wherein backing means comprises:

a first disc member having an abrasive material on one side thereof; and a second disc member having an abrasive material on one side thereof and an opposite side adhesively attached to the opposite side of said first disc member.

3. A sanding disc in accordance with claim 2, wherein said intermediate member is a disc having two opposed substantially planar disc carrying surfaces and the opposite sides of said first and second disc members are each attached to one of the disc carrying surfaces.

4. A finishing article in accordance with claim 3, wherein said intermediate member has a diameter approximately equal to the diameter of said disc members.

5. A finishing article in accordance with claim 3, wherein said intermediate member has a diameter less than the diameter of said disc members.

6. A finishing article in accordance with claim 1, wherein said backing means has a circular shape with a diameter from about 0.75 to 9 inches.

7. A finishing article in accordance with claim 1, wherein said intermediate member is made from one of a plastic, metal and synthetic material.

8. A sanding disc in accordance with claim 7, wherein the material and the dimensions for the intermediate member are chosen to provide a desired stiffness for said sanding disc.

9. A finishing article in accordance with claim 1, wherein said central bore of said intermediate member is at least partially threaded, prior to engaging the support member, with an integral thread size from ¼ inch diameter 20 threads per inch to ⅝ inch diameter 11 threads per inch.

10. A sanding disc in accordance with claim 1, wherein said support member comprises a spindle having engaging means at one end thereof the other end being engagable with a drive member; and a locking member, defining a central bore, engaging the engaging means of said spindle and adjusting a length of the spindle means available for engagement with said intermediate member.

11. A disposable, flexible, nonvitrified double sided sanding disc for rotatable engagement with a support member having engaging means on one end thereof, said double-sided sanding disc comprising:

a flexible circular backing member defining a central opening and having two opposed substantially circular planar surfaces each having abrasive material permanently affixed directly to and only on both said circular planar surfaces prior to use; and a portion of said central opening lying substantially between said two planar surfaces having means engagable with engaging means on one end of a support member for supporting said sanding disc and transmitting rotational movement from said support member to said sanding disc whereby said sanding disc can be detachable connected to said support member by the locking member so that both abrasive surfaces can be used for finishing an article.

12. A sanding disc according to claim 11, wherein said backing member comprises:

a first disc member having an abrasive material on one side thereof; and a second disc member having an abrasive material on one side thereof and an opposite side adhesively attached to the opposite side of said first disc member.

13. A sanding disc in accordance with claim 11, wherein said support member comprises a spindle having engaging means at one end thereof the other end being engagable with a drive member; and a locking member, defining a central bore, engaging the engaging means of said spindle and adjusting a length of the engaging means available for engagement with said intermediate member.

14. A disposable, flexible, non-vitrified double-sided sanding disc, for rotatable engagement with a support member having engaging means on one end thereof, said double-sided sanding disc having two opposed abrasive finishing surfaces comprising:

flexible circular backing means defining a central opening and having two opposed substantial circular planar surfaces each having abrasive material permanently affixed directly to and only on both said circular planar surfaces; and an intermediate member, defining a central bore, being positioned in said central opening and being attached to said backing means, said central bore and said central opening being coaxial with one another, a portion of said central bore being engagable with engaging means on one end of a support member for transmitting rotational movement from said support member to said sanding disc wherein said engagable portion of said central bore lies substantially between said two planar surfaces and has means therein permitting a threaded portion to be formed by engagement with said engaging means whereby said sanding disc can be detachably connected to said support member by said intermediate member so that both abrasive surfaces can be used for finishing an article.

15. A sanding disc in accordance with claim 1, wherein said intermediate member is a rivet means having two flange portions which compressibly clamp both outer edges of the central opening to securely attach said intermediate member to said backing means.

16. A sanding disc in accordance with claim 2, wherein said intermediate member is a rivet means having two flange portions which compressibly clamp both outer edges of the central opening to securely attach said intermediate member to said backing means.

17. A sanding disk in accordance with claim 1, wherein said support member comprises a spindle having engaging means at one end thereof and the opposite end thereof being engagable with a drive member;

a reinforcing member, defining a central bore, being supported by the engaging means of said spindle via the central bore; and locking means engaging said engaging means, adjacent said reinforcing member on a side thereof facing the opposite end of the spindle, for adjusting the length of said engaging means extending out through said central bore of the reinforcing member available for engagement with said intermediate member.

18. A sanding disc in accordance with claim 14, wherein said intermediate member is a rivet means having two flange portions which compressibly clamp both outer edges of the central opening to securely attach said intermediate member to said backing means.

19. A sanding disk in accordance with claim 14, wherein said support member comprises a spindle having engaging means at one end thereof and the opposite end thereof being engagable with a drive member;

a reinforcing member, defining a central bore, being supported by with the engaging means of said spindle via the central bore; and locking means engaging said engaging means, adjacent said reinforcing member on a side thereof facing the opposite end of the spindle, for adjusting the length of said engaging means extending out through said central bore of the reinforcing member available for engagement with said intermediate member.

* * * * *

UNITED STATES PATENT AND TRADEMARK OFFICE

CERTIFICATE OF CORRECTION

PATENT NO. : 4,951,423

DATED : August 28, 1990

INVENTOR(S) : Courtland M. Johnson

It is certified that error appears in the above-identified patent and that said Letters Patent is hereby corrected as shown below:

Column 5, line 17 change "integral" to "internal";

line 45 change "locking" to "backing".

Signed and Sealed this

Thirty-first Day of December, 1991

*Attest:*

HARRY F. MANBECK, JR.

*Attesting Officer*

*Commissioner of Patents and Trademarks*